US011841684B2

(12) United States Patent
Stranczl et al.

(10) Patent No.: US 11,841,684 B2
(45) Date of Patent: Dec. 12, 2023

(54) TIMEPIECE DISPLAY MECHANISM COMPRISING AT LEAST ONE RESILIENT HAND

(71) Applicant: Montres Breguet S.A., L'Abbaye (CH)

(72) Inventors: Marc Stranczl, Nyon (CH); Patrice Golay, Le Sentier (CH); Pierre Cusin, Villars-Burquin (CH); Alexandre Fussinger, Wavre (CH)

(73) Assignee: Montres Breguet S.A., L'Abbaye (CH)

( * ) Notice: Subject to any disclaimer, the term of this patent is extended or adjusted under 35 U.S.C. 154(b) by 624 days.

(21) Appl. No.: 16/979,685

(22) PCT Filed: Jul. 24, 2019

(86) PCT No.: PCT/EP2019/069968
§ 371 (c)(1),
(2) Date: Sep. 10, 2020

(87) PCT Pub. No.: WO2020/025428
PCT Pub. Date: Feb. 6, 2020

(65) Prior Publication Data

US 2021/0048782 A1 Feb. 18, 2021

(30) Foreign Application Priority Data

Jul. 31, 2018 (EP) ..... 18186552

(51) Int. Cl.
*G04B 13/00* (2006.01)
*G04B 19/04* (2006.01)
(Continued)

(52) U.S. Cl.
CPC ..... *G04B 19/02* (2013.01); *G04B 9/005* (2013.01); *G04B 13/001* (2013.01);
(Continued)

(58) Field of Classification Search
CPC .. G04B 19/048; G04B 45/00; G04B 45/0061; G04B 19/042; G04B 19/02;
(Continued)

(56) References Cited

U.S. PATENT DOCUMENTS 4,447,159 A * 5/1984 Weller ..... G04B 19/223 368/21
5,617,377 A * 4/1997 Perret, Jr. ..... A44C 5/14 368/282
(Continued)

FOREIGN PATENT DOCUMENTS

CH 700 035 A2 6/2010
CN 101206454 A 6/2008
(Continued)

OTHER PUBLICATIONS

Combined Chinese Office Action and Search Report dated Mar. 31, 2021 in Chinese Patent Application No. 201980011737.4, 6 pages.
(Continued)

*Primary Examiner* — Sean Kayes
(74) *Attorney, Agent, or Firm* — Oblon, McClelland, Maier & Neustadt, L.L.P.

(57) ABSTRACT

A timepiece resilient hand with drive pipes at the ends thereof, including a display index which is at a variable distance from the pipes, and including flexible segments between each pipe and the index each with a web having a substantially constant section, at least one flexible segment thereof includes discontinuous elements projecting from the web thereof in a plane perpendicular to the axis of the pipes and defining, along this web, an alternation of sections, the stiffnesses thereof per unit of length are different from one another, and/or at least one web includes a succession of areas of opposite concavities, projecting on a plane perpendicular to the axis of the pipes.

19 Claims, 4 Drawing Sheets

(51) Int. Cl.

| | |
|---|---|
| ***G04B 19/02*** | (2006.01) |
| ***G04B 45/00*** | (2006.01) |
| ***G04B 9/00*** | (2006.01) |
| ***G04B 13/02*** | (2006.01) |
| ***G04B 19/08*** | (2006.01) |

(52) U.S. Cl.
CPC ..... *G04B 13/007* (2013.01); *G04B 13/008* (2013.01); *G04B 13/021* (2013.01); *G04B 19/042* (2013.01); *G04B 19/048* (2013.01); *G04B 19/082* (2013.01); *G04B 45/0061* (2013.01); *G04B 13/02* (2013.01)

(58) Field of Classification Search
CPC .. G04B 13/008; G04B 13/001; G04B 13/007; G04B 9/005; G04B 13/021; G04B 19/082; G04B 13/02
USPC ..... D10/39, 127
See application file for complete search history.

(56) References Cited

U.S. PATENT DOCUMENTS

| | | | | |
|---|---|---|---|---|
| 7,154,815 | B2 * | 12/2006 | Born | G04B 19/262 368/80 |
| 2015/0109891 | A1 * | 4/2015 | Stranczl | G04B 19/048 368/238 |

FOREIGN PATENT DOCUMENTS

| | | | |
|---|---|---|---|
| CN | 201576169 | U | 9/2010 |
| CN | 104570687 | A | 4/2015 |
| CN | 107092180 | A | 8/2017 |
| EP | 2 863 274 | A1 | 4/2015 |
| WO | WO 2012/061947 | A2 | 5/2012 |

OTHER PUBLICATIONS

International Search Report dated Dec. 9, 2019 in PCT/EP2019/069968 filed on Jul. 24, 2019, 2 pages.

* cited by examiner

TIMEPIECE DISPLAY MECHANISM COMPRISING AT LEAST ONE RESILIENT HAND

CROSS-REFERENCE TO RELATED APPLICATIONS

The present application is a national stage entry of International Application No. PCT/EP2019/069968, filed Jul. 24, 2019, which claims priority to European Patent Application No. 18186552.8, filed on Jul. 31, 2018, the entire content and disclosure of which are incorporated by reference herein.

FIELD OF THE INVENTION

The invention relates to a timepiece display mechanism comprising at least one variable-geometry resilient hand, which comprises a first drive pipe integral with a first end of a flexible strip, and a second drive pipe integral with another end of said flexible strip, and comprising a display index which, in an unstressed free state of said resilient hand wherein both said first pipe and said second pipe are not subjected to any stress and are remote from one another, is remote from said first pipe and from said second pipe, the operating position of said resilient hand being a stressed position where said first pipe and said second pipe are coaxial to one another about an output axis, said display mechanism comprising first means for driving said first pipe about said output axis, and second means for driving said second pipe about said output axis, said first drive means and second drive means being arranged so as to deform said flexible strip, by varying the angular position of said second pipe relative to the angular position of said first pipe about said output axis, and so as to vary the radial position of said display index relative to said output axis, said resilient hand comprising at least one first flexible segment between said first pipe and said index with a first web having a substantially constant section, and a second flexible segment between said second pipe and said index with a second web having a substantially constant section.

The invention further relates to a horological movement comprising at least one such display mechanism.

The invention further relates to a timepiece comprising at least one such horological movement, and/or comprising at least one such display mechanism.

The invention further relates to a scientific apparatus comprising at least one such horological movement, and/or at least one such display mechanism.

The invention relates to the field of analogue display mechanisms using moving mechanical components, for timepieces or scientific apparatuses.

BACKGROUND OF THE INVENTION

Patent documents EP2863274 and EP3159751 filed by MONTRES BREGUET SA disclose different arrangements of resilient hands, allowing a display on a timepiece to be adapted to the shape of the case or dial thereof, thanks to a radial extension obtained by controlling such a resilient hand which comprises flexible segments driven separately.

SUMMARY OF THE INVENTION

The invention proposes a reliable and extremely robust solution to the problem of providing an indicator having variable radial extension according to the position and control thereof.

For this purpose, the invention relates to a timepiece display mechanism comprising at least one resilient hand, which comprises a first drive pipe integral with at least one flexible strip.

The invention further relates to a horological movement comprising at least one such display mechanism.

The invention further relates to a timepiece comprising at least one such horological movement, and/or comprising at least one such display mechanism.

The invention further relates to a scientific apparatus comprising at least one such horological movement, and/or at least one such display mechanism.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

The technology of the resilient hand offers numerous new display possibilities, which allow customisations which are always highly desirable, especially for watches.

However, the best possible visibility of the hand must be guaranteed: a hand comprising arms of a thickness of 40 μm and a height of 200 μm is thus very thin, and enhancing the visibility thereof is advantageous, as well as proposing new functions linked to the specific arrangement of the arms of the hand.

Figure 1A:
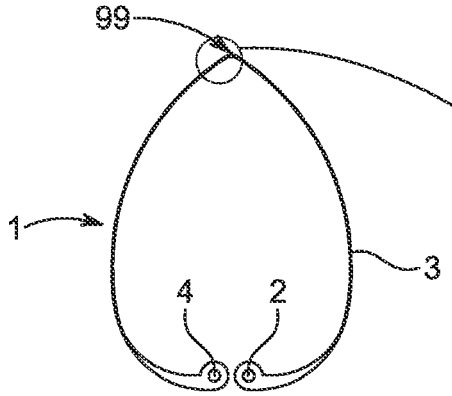
FIG. 1A diagrammatically shows a plan view of a resilient hand according to the teachings of the European patent applications No. 2863274 and 3159751, with a more detailed perspective view of the tip thereof shown in FIG. 1B, which resilient hand comprises two smooth flexible strips, each joining the common tip and one respective pipe.
Figure 1B:
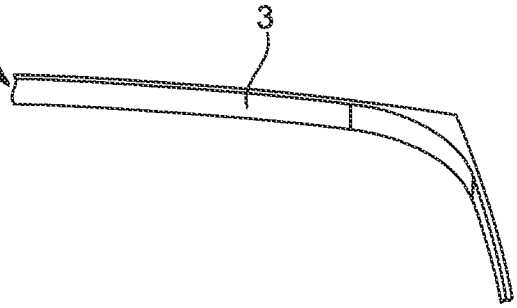

FIGS. 1A and 1B show such a thin resilient hand 1 comprising arms 3 which have a thickness of 40 μm and a height of 200 μm, which extend between the respective pipes 2 and 4 thereof and a common tip forming an index 99.

The term "height" is understood herein to mean any dimension measured in the direction of an output shaft D, which is the common axis shared by the two pipes 2 and 4. The term "thickness" is understood herein to mean a dimension measured in a plane perpendicular to this output axis D.

This resilient hand 1 comprises at least one first flexible segment 501 between the first pipe 2 and the index 99 with a first web 601 having a substantially constant section, and a second flexible segment 502 between the second pipe 4 and the index 99 with a second web 602 having a substantially constant section.

Figure 2:
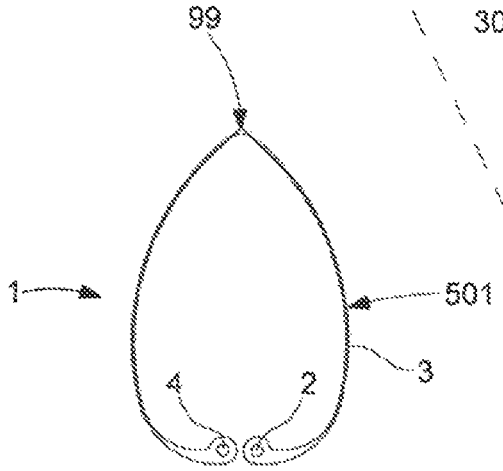
FIG. 2 diagrammatically shows a plan view of a hand according to the invention which comprises, on each of the two branches thereof, discontinuous elements distributed along a web, which has a substantially constant section.
Figure 3:
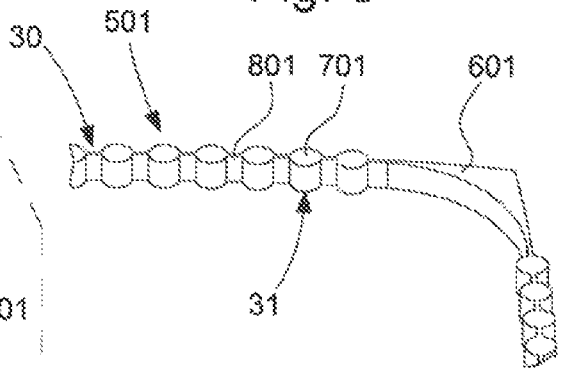
FIG. 3 shows a detailed perspective view of a branch in FIG. 2, wherein the discontinuous elements are cylinders centred on the web.

FIGS. 2 and 3 show one alternative embodiment similar to a necklace structure. The hand is still made along a single level. Larger element, in this case small discontinuous cylindrical elements 701 are distributed on the arms of the hand to increase the visibility thereof, as shown on a first flexible segment 501 of the arm 3. The links 801 between these elements 701 must be thinned in order to retain the same flexibility of the hand 1. It goes without saying that the mass of such small discontinuous cylindrical elements 701 must remain reasonable in order to prevent too significant deformations in the event of an impact involving a hand that is too weighed down, which deforms to a greater extent, all the more so since the links 801 between the elements 701 are more flexible than in the conventional case shown in FIGS. 1A and 1B.

Figure 4:
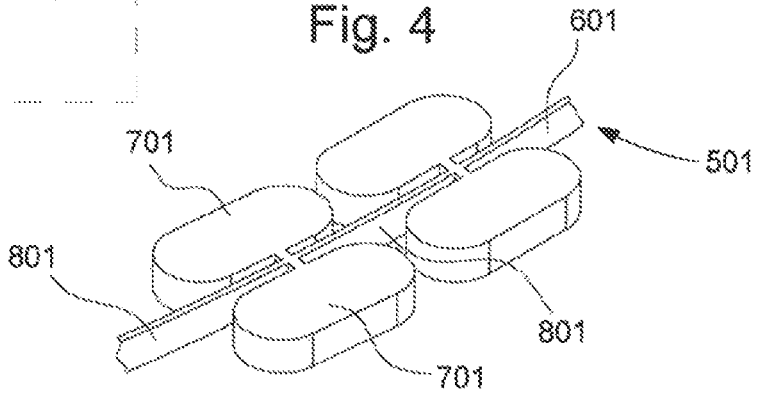
FIG. 4 shows, similarly to FIG. 3, another alternative embodiment wherein the discontinuous elements are substantially planar plates or leaves, extending substantially in the plane of the hand in the unstressed rest position thereof, each plate being connected to the web by a thin joining bar; in this FIG. 4, the plates extend on both sides of the web.
Figure 5:
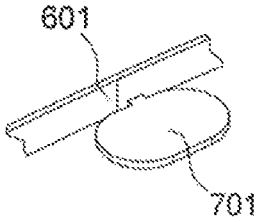
FIG. 5 shows, similarly to FIG. 4, another alternative embodiment with leaves having a height that is less than that of the web, and on one side of the web only.

In order to minimise the stiffening of the hand 1 by large cells or beads, the stiff part can be reduced with leaf-shaped structures, in particular over the entire height, as shown in the alternative embodiment in FIG. 4, the inertia whereof remains high.

FIGS. 5 to 8 show leaf-shaped structures of lower inertia, whereby the hand 1 is made along two levels. The hand has a main structure, for example having a thickness of 40 μm and a height of 200 μm, as shown in FIGS. 1A and 1B. Leaves 701 or other structures, such as the letters in FIGS. 7 and 8, of a lesser height, for example 40 μm in height, are attached to this structure in order to make the hand 1 more visible.

Figure 6:
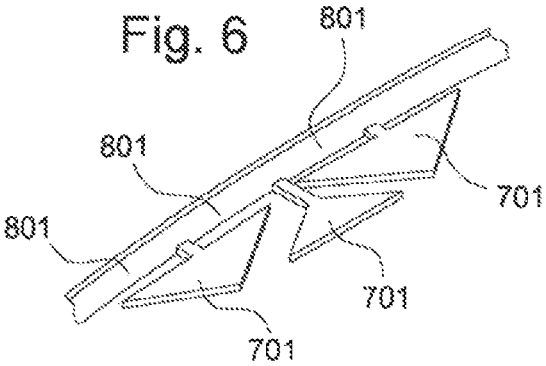
FIG. 6 shows, similarly to FIG. 5, another alternative embodiment with leaves on one side of the web only, having contours that substantially complement one another.

FIG. 6 shows leaves or plates on only one side of the web, with contours that substantially complement one another, designed to allow the arm of the hand to bend without these leaves 701 interfering with one another, while presenting the user with an almost continuous surface that is wide enough and has good contrast relative to the surrounding background, dial or similar element.

Figure 7:
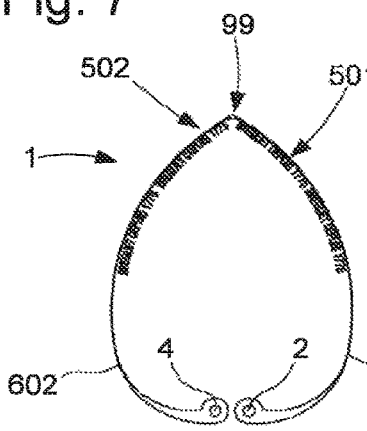
FIG. 7 shows, similarly to FIG. 4, another alternative embodiment with leaves on one side of the web only, these leaves, which are different to one another, in this case form letters or numbers.
Figure 8:
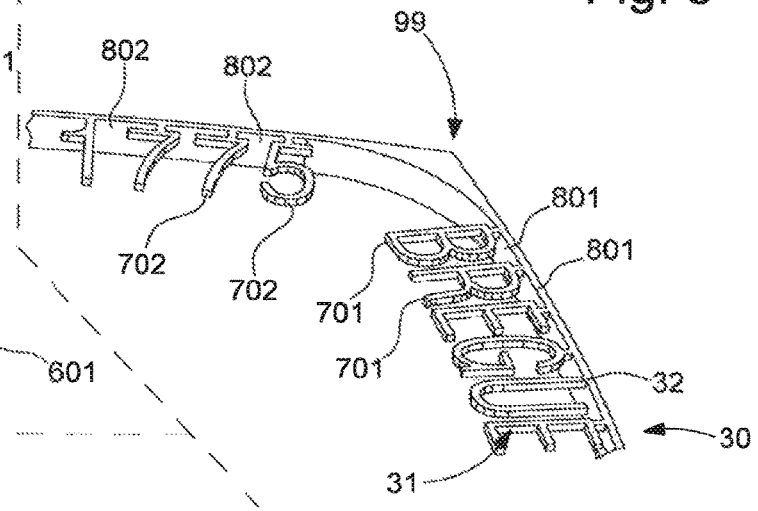
FIG. 8 shows a detailed view of FIG. 7 in the vicinity of the tip.

The example in FIGS. 7 and 8 thus shows, in a non-limiting manner, leaves formed by letters 701 or numbers 702 with a height of 40 μm. The advantage is not weighing down the hand 1, nor stiffening same to a too great extent. It is important to understand that each letter assembly 30 comprises a letter leaf 31 which is attached to the hand by a small rod 32 which does not stiffen the structure.

Figure 9:
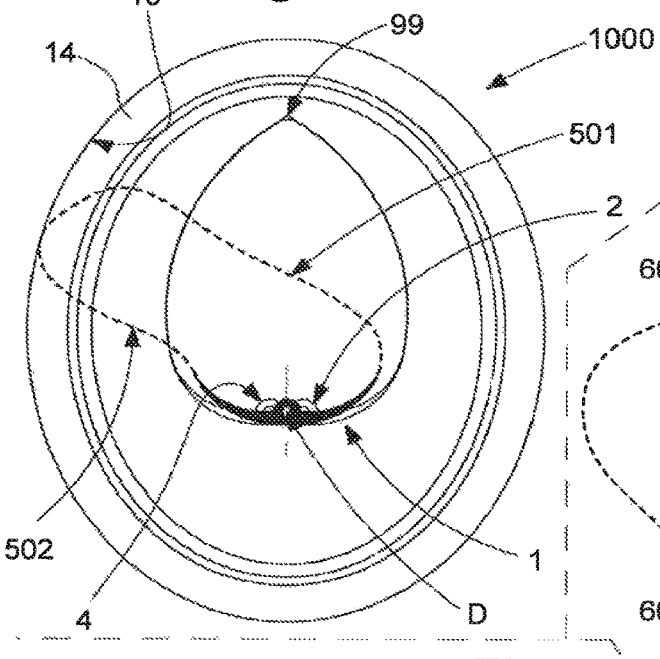
FIG. 9 diagrammatically shows a plan view of the maximum engagement between such a resilient hand, shown to be deformed via a broken line for example during an impact, with an inside surface of a watch case or of an external element, which limits the travel of the most external deformed branch of the hand.
Figure 10:
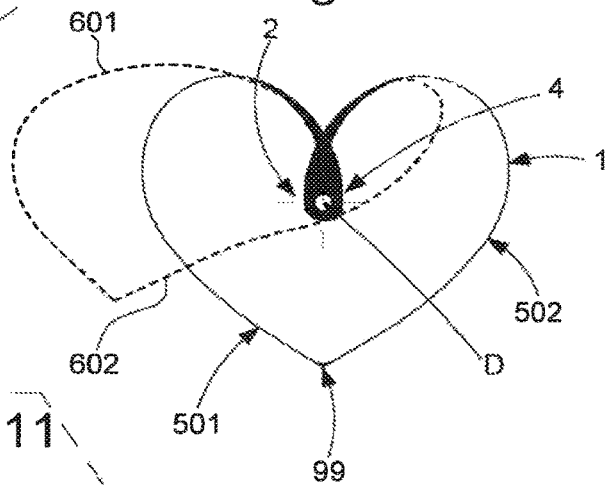
FIG. 10 is another illustration showing a planar view of the deformation of such a resilient hand with, in this instance, the limitation being at the common axis shared by the two pipes.

The protection of a resilient hand against impacts is high since, in the event of an impact, the hand could touch either a component of the structure of the watch such as an inside surface 15 of the bezel 14 in FIG. 9, or the central pipe 2 or 4 as shown in FIG. 10.

This is why the alternative embodiment of the leaf-shaped structure is of interest. Advantageously, the leaves, or the letters or similar elements can be positioned on the internal side of the hand in the vicinity of the point only, since the internal side does not come into contact with the bezel, and on the other hand the leaves do not run the risk of becoming folded since the impact is absorbed by the rod of the hand, and in particular in the vicinity of the pipes, whereby the hand preferably does not comprise any leaves.

Figure 11:
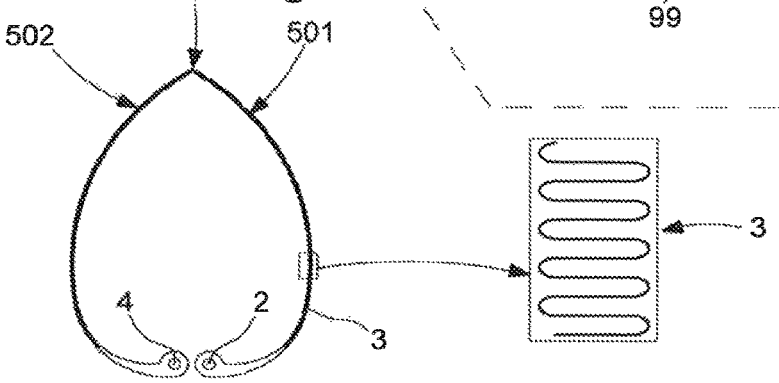
FIG. 11 diagrammatically shows a plan view of a resilient hand with an enlarged detailed view of one of the branches thereof, the web of the resilient hand extending in the shape of a serpentine on either side of a centre line.

FIG. 11 shows yet another alternative embodiment, wherein the hand is at least locally produced in a serpentine shape.

Figure 12:
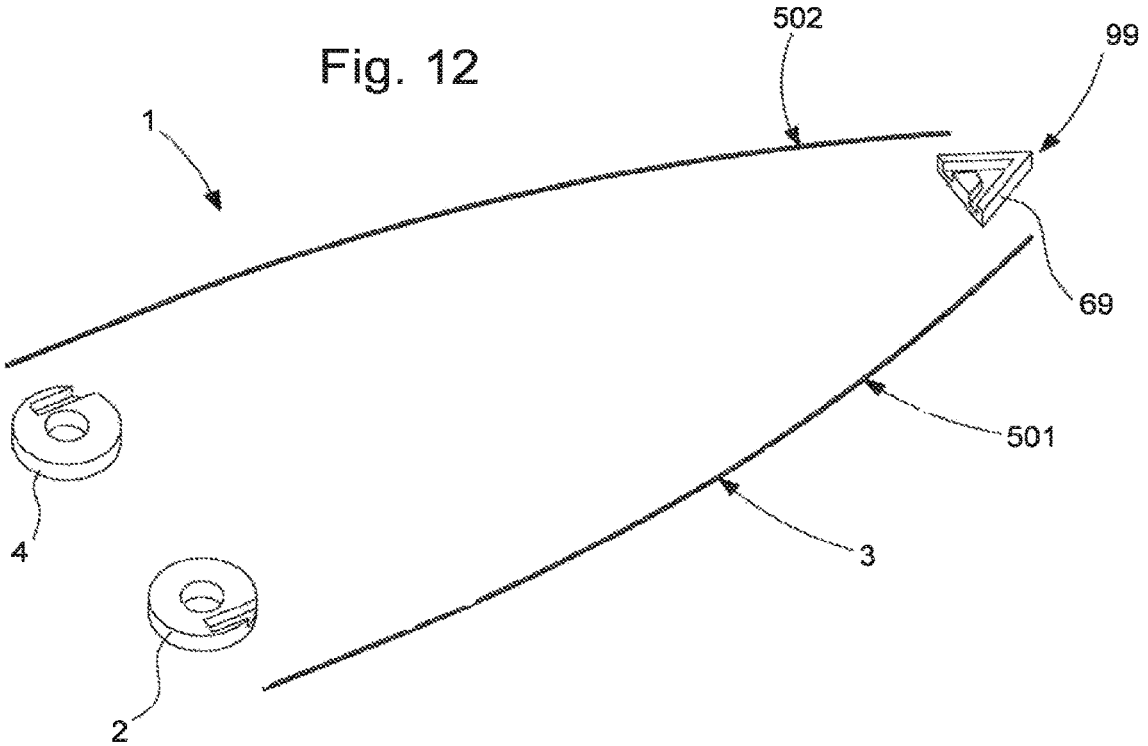
FIG. 12 diagrammatically shows a perspective view of a composite flexible hand, the flexible branches whereof are assembled end-to-end on a common rigid tip, and each on one of the pipes.

FIG. 12 shows one alternative embodiment whereby the hand is assembled. For this purpose, the tip and the pipes of the hands must be produced separately and the arms of the hand must be bonded, set, welded, brazed, screwed, pinned or similarly fastened in these components. For example, the arms of the hand can be made of a noble polymer, for example carbon fibre, or of a superelastic alloy of the "Nitinol" type or of a similar material. The advantage of these materials is that they better withstand impacts since they are able to absorb significant deformations.

Figure 13:
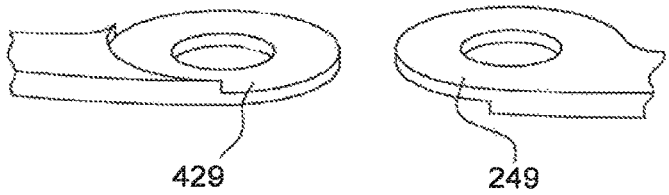
FIG. 13 diagrammatically shows a perspective view of a composite flexible hand, each of the pipe-forming ends whereof are situated halfway along the height of the hand.

FIG. 13 shows one alternative embodiment for reducing the overall axial dimensions of the hand, by producing the pipes over a plurality of levels, such that they are complementary to the assembly.

Figure 14:
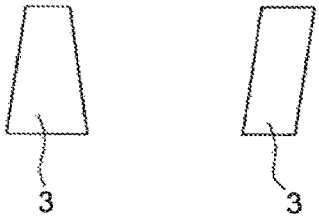
FIG. 14 diagrammatically shows a sectional view of two alternative embodiments of a resilient hand web having a section that is not rectangular: trapezoid on the left, parallelogram on the right.
Figure 22:
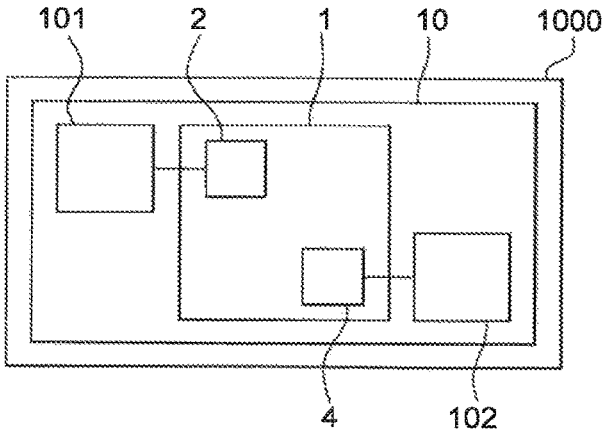
FIG. 22 is a block diagram showing a timepiece, in particular a watch, comprising a display mechanism comprising such a resilient hand.

FIG. 14 shows sections that avow for the three-dimensional deformation of the hand, which can be advantageous when passing over an obstacle, or even when creating a specific optical effect. The section of the hand in FIGS. 1A and 1B is rectangular. A trapezoidal or parallelepipedal hand section can be considered. When stressing the hand, it becomes deformed outside of the plane and can thus pass over an obstacle such as an applique, an aperture, a frame or other element, which amounts to designing a specific trajectory in order to avoid an element of the dial or of the watch.

Figure 15:
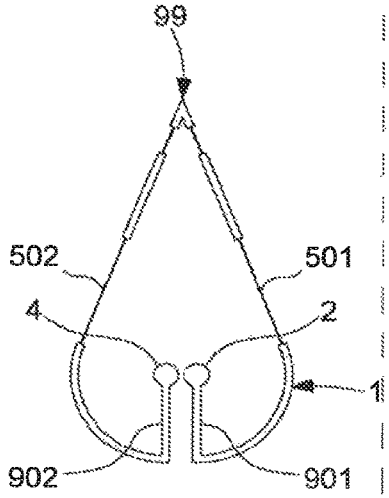
FIGS. 15 to 17 diagrammatically show a plan view of the variations in the length of a resilient hand according to the invention, in the free state in FIG. 15, in a first relative position of the pipes in FIG. 16 wherein the hand is at maximum radial extension, and in a second relative position of the pipes in FIG. 17 wherein the hand is at minimum radial extension.
Figure 16:
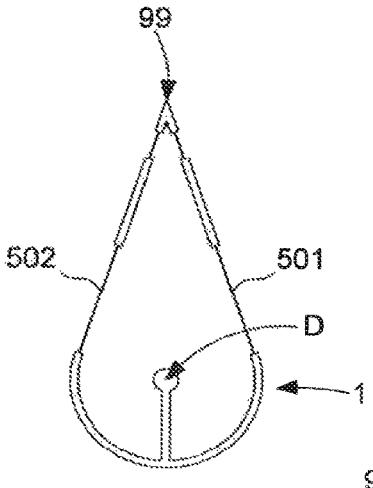
Figure 17:
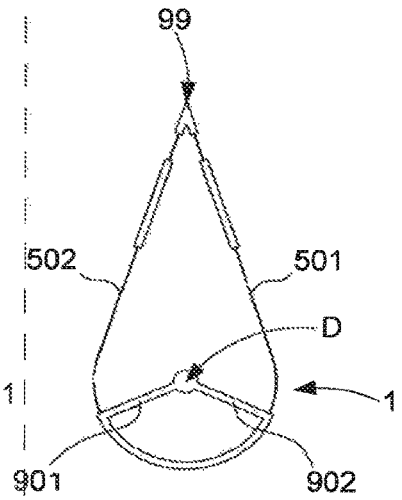

FIGS. 15 to 17 show the variations in the length of a resilient hand which, in the long position, has the shape of a leaf and, in the short position, has the shape of a droplet. The act of superimposing the areas 901, 902 situated in the vicinity of the pipes 2 and 4 allows additional information to be displayed, for example by the 120° closed sector shape in FIG. 17, which can correspond to a specific time interval, or other information.

Figure 18:
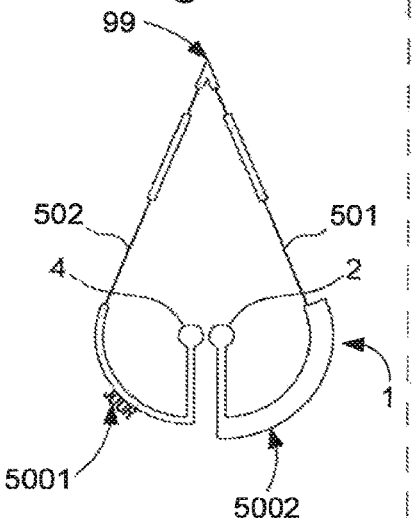
FIGS. 18 to 20 show, similarly to FIGS. 15 to 17, a hand with highly differentiated branches, in order to produce a display indicative of the daytime in FIG. 19 and of the night-time in FIG. 20.
Figure 19:
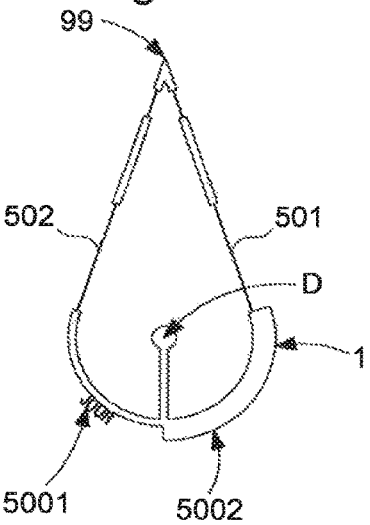
Figure 20:
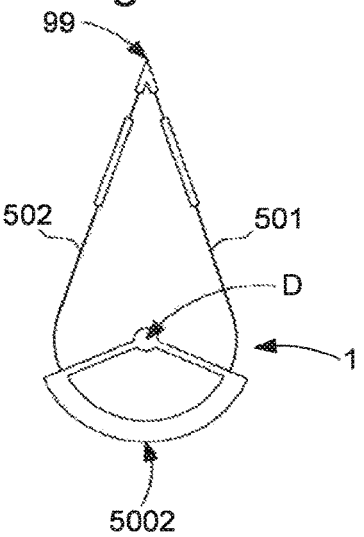

FIGS. 18 to 20 show a hand with highly differentiated branches, in order to produce a display indicative of the daytime in FIG. 19 and of the night-time in FIG. 20. An indication is thus made with the lateral movement of the hand, or the angle of the bases, and not necessarily with the tip of the hand. It goes without saying that the displays resulting from the angular position and from the radial position of the tip can be cumulated with the indications provided by the partial or full superimposition of the branches of the hand. In this case, for example, letters 5001 are produced on the left arm 502 of the hand and a wider area 5002 on the right arm 501. When the two arms of the hand are superimposed on one another, the wider area 5002 conceals the text 5001 written on the left arm.

The invention allows two pieces of information, for example hours and minutes, to be coupled on the same hand. For example, the angular indication of the hand represents the hour, the length of the hand indicates the minutes.

In an alternative embodiment, the hand does not rotate about itself but merely changes in length in order to display information in a line. This can in particular be used for a function selector, a power reserve display or other feature.

Figure 21:
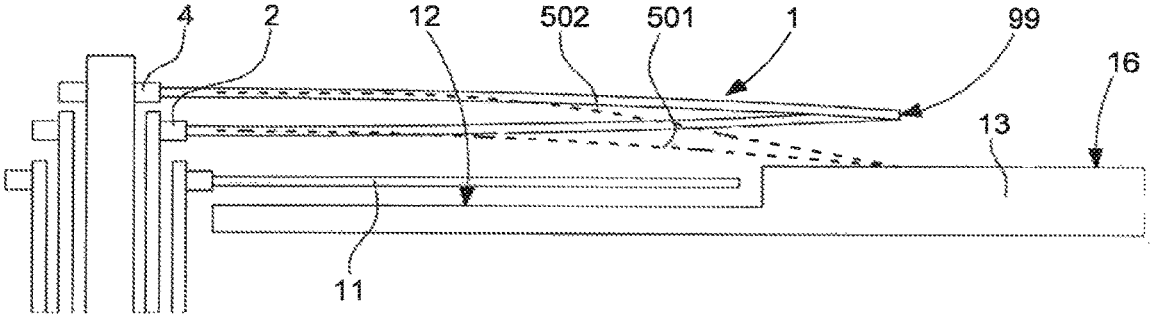
FIG. 21 diagrammatically shows a sectional view of a timepiece, in particular a watch, comprising such a resilient hand superimposed with a conventional hand, whereby, in order to prevent any interference between these hands, the conventional hand is housed in a recess of the dial or of a plate, and whereby an offset plane acts as a bearing and abutment surface for the resilient hand in any position of the extension thereof.

FIG. 21 shows a hand, in particular an hour hand 11, which is enclosed inside a recess 12, since the resilient hand can still undergo significant deformation, in particular greater than a conventional hand, during impacts. In order to prevent, for example, a resilient minute hand from getting caught with the hour hand, a lower hand can be produced that is short enough to prevent getting caught or, as shown, a hand can be produced such that it is buried in the dial so as not to be accessible by the resilient hand, the axial travel whereof is limited by a top surface 16 of a dial 13, or similar element.

Thus, the invention relates to a timepiece display mechanism comprising at least one variable-geometry resilient hand 1, comprising a first drive pipe 2 integral with a first end of a flexible strip 3, and a second drive pipe 4 integral with another end of the flexible strip 3, and comprising a display index 99. In an unstressed free state of the resilient hand 1 wherein both the first pipe 2 and the second pipe 4 are not subjected to any stress and are remote from one another, this index 99 is remote from the first pipe 2 and from the second pipe 4. The operating position of the resilient hand 1 is a stressed position where the first pipe 2 and the second pipe 4 are coaxial to one another about an output axis D.

The display mechanism 10 comprises first means for driving the first pipe 2 about the output axis D, and second means for driving the second pipe 4 about the output axis D. The first drive means 101 and the second drive means are arranged so as to deform the flexible strip 3, by varying the angular position of the second pipe 4 relative to the angular position of the first pipe 2 about the output axis D, and so as to vary the radial position of the display index 99 relative to the output axis D.

The resilient hand 1 comprises at least one first flexible segment 501 between the first pipe 2 and the index 99 with a first web 601 having a substantially constant section, and a second flexible segment 502 between the second pipe and the index 99 with a second web 602 having a substantially constant section.

According to the invention, the first flexible segment 501 comprises first discontinuous elements 701 projecting from the first web 601 and extending substantially parallel to a plane perpendicular to the output axis D and defining, along the first web 601, an alternation of sections, the stiffnesses whereof per unit of length are different from one another, and/or the second flexible segment 502 comprises second discontinuous elements 702 projecting from the second web 602 and extending substantially parallel to a plane perpendicular to the output axis D and defining, along the second web 602, an alternation of sections, the stiffnesses whereof per unit of length are different from one another, and/or the first web 601 and/or the second web 602 comprises a succession of areas of opposite concavities, projecting on a plane perpendicular to the output axis D.

More particularly, the first flexible segment 501 comprises first discontinuous elements 701 projecting from the first web 601 and extending substantially parallel to a plane perpendicular to the output axis D and defining, along the first web 601, an alternation of sections, the stiffnesses whereof per unit of length are different from one another, and/or the second flexible segment 502 comprises second discontinuous elements 702 projecting from the second web 602 and extending substantially parallel to a plane perpendicular to the output axis D and defining, along the second web 602, an alternation of sections, the stiffnesses whereof per unit of length are different from one another, and the first elements 701 and/or the second elements 702 are inertial elements each having an inertia that is greater than the inertia of the resilient sections 801, 802, of the first web 601, respectively of the second web 602, inserted between first successive elements 701 and/or respectively second successive elements 702.

More particularly, the first flexible segment 501 comprises first discontinuous elements 701 projecting from the first web 601 and extending substantially parallel to a plane perpendicular to the output axis D and defining, along the first web 601, an alternation of sections, the stiffnesses whereof per unit of length are different from one another, and/or the second flexible segment 502 comprises second discontinuous elements 702 projecting from the second web 602 and extending substantially parallel to a plane perpendicular to the output axis D and defining, along the second web 602, an alternation of sections, the stiffnesses whereof per unit of length are different from one another. Additionally and more particularly, in the direction of the output axis D, the height of the first elements 701 and/or of the second elements 702 is less than that of the respective web 601, 602.

More particularly, in the direction of the output axis D, the first elements 701 are arranged at a first level that is far enough away from a second level at which the second elements 702 are arranged, so as to allow the superimposition thereof and the remote crossover thereof during the elongation or contraction of the resilient hand 1.

More particularly, the first elements 701 and the second elements 702 extend only on one internal side of the resilient hand 1 delimited by the first web 601 and the second web 602 so as to ensure, in the event of an impact, direct bearing of the first web 601 or the second web 602 on an element of a timepiece into which the resilient hand 1 is incorporated.

More particularly, the first elements 701 and the second elements 702 are only present in the vicinity of the index 99, and, in the vicinity of the first pipe 2 and of the pipe 4, the resilient hand 1 only comprises the first web 601 and the second web 602, over a curvilinear length that is sufficient for ensuring, in the event of an impact, direct bearing of the first web 601 or the second web 602 on the first pipe 2 or the second pipe 4.

More particularly, at least one part of the flexible strip 3 comprises a flat resilient strip wound into a serpentine.

More particularly, the section of at least one part of the flexible strip 3 is an oblique parallelogram or trapezoid so as to allow for deformation outside of the plane during at least one part of the elongation or of the retraction of the resilient hand 1.

More particularly, the resilient hand 1 is made in one piece and comprises at least one part of the flexible strip 3 made of carbon fibre or a superelastic alloy that is irreversibly made integral with a solid tip element 69 at an index 99 on the one hand, and a first pipe 2 or second pipe 4 on the other hand.

More particularly, the resilient hand 1 is designed to occupy a first long configuration taking on a leaf shape or a second short configuration taking on a droplet shape.

More particularly, the resilient hand 1 comprises at least one first flexible segment 501 comprising a first decoration 5001 and a second flexible segment 502 comprising a second decoration 5002 which is designed to cover, by superimposition, over a part of the relative angular travel between the first pipe 2 and the second pipe 4, all or part of the first decoration 5001, or vice-versa.

More particularly, the first decoration 5001 or second decoration 5002 comprises a daytime/night-time indication or AM/PM indication designed to be seen by the user, and the second decoration 5002 or respectively the first decoration 5001 is designed to completely conceal this indication for an appropriate period of time.

More particularly, the first web 601 and/or the second web 602 comprises a strand 30, the largest dimension of the section whereof is substantially parallel to the output axis D, and the resilient hand 1 comprises, in at least one plane perpendicular to the output axis D, a plurality of inertial elements 31, each attached to the strand by a rod 32, the section whereof is less than that of the strand 30 and than the smallest section of the inertial element 31 which is formed by a first element 701 or by a second element 702.

More particularly, the first pipe 2 or second pipe 4 integral with the flexible strip 3 comprises an end flange 249, the height whereof is less than that of the flexible strip 3 for the superimposition thereof with another second pipe 4 or first pipe 2.

More particularly, the flexible strip 3 is formed by a plurality of flexible segments 5 connected end-to-end at tips 6, including at least one first segment 5, 520, which bears the first pipe 2 at a first end 52 and is flexible between the first pipe 2 and a first of the tips 6, the resilient hand 1 comprising a second segment 5, 540, bearing the second pipe 4 at a second end 54.

The invention further relates to a variable-geometry timepiece display mechanism 10 comprising at least one such resilient hand 1, and first means 101 for driving the first pipe 2 and second means 102 for driving the second pipe 4. More particularly, the display mechanism 10 is designed to display a first magnitude by way of the angular position of the resilient hand 1, and to display a second magnitude by way of the elongation, relative to the output axis D, of the resilient hand 1.

More particularly, the first drive means 101 and the second drive means 102 are designed to hold the angular position in a fixed position, and to provide a linear display given solely by the elongation of the resilient hand 1.

More particularly, the first drive means 101 or the second drive means 102 are held at a standstill.

More particularly, the display mechanism 10 comprises at least one other display hand 11 moving in a counterbore 12 of a dial 13 or of a structure, and the outer diameter of the counterbore 12 is smaller than the smallest elongation of the resilient hand 1 which is arranged above a top surface 16 of the dial 13 or of the structure, situated above the other hand 11.

More particularly, the display mechanism 10 comprises means for controlling the first drive means 101 and the second drive means 102, which are designed to cause an out-of-plane twisting or retraction of the resilient hand 1 in the vicinity of an obstacle interfering with the trajectory thereof.

The invention further relates to a timepiece 1000, in particular a watch, comprising at least one such display mechanism 10, and/or at least one such resilient hand 1.

The invention claimed is:

1. A timepiece display mechanism comprising:

at least one variable-geometry resilient hand which comprises a first drive pipe integral with a first end of a flexible strip, and a second drive pipe integral with another end of said flexible strip, and comprising a display index which, in an unstressed free state of said resilient hand wherein both said first pipe and said second pipe are not subjected to any stress and are remote from one another, is remote from said first pipe and from said second pipe, the operating position of said resilient hand being a stressed position where said first pipe and said second pipe are coaxial to one another about an output axis;

first means for driving said first pipe about said output axis and second means for driving said second pipe about said output axis, said first drive means and second drive means being arranged so as to deform said flexible strip, by varying the angular position of said second pipe relative to the angular position of said first pipe about said output axis, and so as to vary the radial position of said display index relative to said output axis, said resilient hand comprising at least one first flexible segment between said first pipe and said index with a first web having a substantially constant section, and a second flexible segment between said second pipe and said index with a second web having a substantially constant section, wherein:

said first flexible segment comprises first discontinuous elements projecting from said first web and extending substantially parallel to a plane perpendicular to said output axis and defining, along said first web, an alternation of sections, the stiffnesses thereof per unit of length are different from one another, and said second flexible segment comprises second discontinuous elements projecting from said second web and extending substantially parallel to a plane perpendicular to said output axis and defining, along said second web, an alternation of sections, the stiffnesses thereof per unit of length are different from one another, wherein said first elements and said second elements are inertial elements, each having an inertia that is greater than the inertia of resilient sections of said first web, respectively of said second web, inserted between said first successive elements and respectively said second successive elements, and wherein in the direction of said output axis, said first elements are arranged at a first level that is far enough away from a second level at which said second elements are arranged, so as to allow the superimposition thereof and the remote crossover thereof during the elongation or contraction of said resilient hand.

2. The display mechanism according to claim 1, wherein in the direction of said output axis, the height of said first elements and/or of said second elements is less than the height of said respective web.

3. The display mechanism according to claim 1, wherein said first elements and said second elements extend only on one internal side of said resilient hand delimited by said first web and said second web so as to ensure, in the event of an impact, direct bearing of said first web or said second web on an element of a timepiece into which said resilient hand is incorporated.

4. The display mechanism according to claim 1, wherein said first elements and said second elements are only present the vicinity of said index, and in the vicinity of said first pipe and of said pipe, said resilient hand only comprises said first web and said second web, over a curvilinear length that is sufficient for ensuring, in the event of an impact, direct bearing of said first web or said second web on said first pipe or said second pipe.

5. The display mechanism according to claim 1, wherein at least one part of said flexible strip comprises a flat resilient strip wound into a serpentine.

6. The display mechanism according to claim 1, wherein the section of at least one part of said flexible strip is an oblique parallelogram or trapezoid so as to allow for deformation outside of the plane during at least one part of the elongation or of the retraction of said resilient hand.

7. The display mechanism according to claim 1, wherein said resilient hand is made in one piece and comprises at least one part of said flexible strip made of carbon fiber or a superelastic alloy that is irreversibly made integral with a solid tip element at said index, and said first pipe or second pipe.

8. The display mechanism according to claim 1, wherein said resilient hand is configured to occupy a first long configuration taking on a leaf shape or a second short configuration taking on a droplet shape.

9. The display mechanism according to claim 1, wherein said first pipe or said second pipe integral with said flexible strip comprises an end flange, the height thereof is less than the height of said flexible strip for the superimposition thereof with another said second pipe or first pipe.

10. The display mechanism according to claim 1, wherein said flexible strip is formed by a plurality of flexible segments connected end-to-end at tips, including at least one first segment, which bears said first pipe at a first end and is flexible between said first pipe and a first of said tips, said resilient hand comprising a second said segment, bearing said second pipe at a second end.

11. The display mechanism according to claim 10, further comprising first means for driving said first pipe and second means for driving said second pipe, wherein said display mechanism is configured to display a first magnitude by way of the angular position of said resilient hand, and to display a second magnitude by way of the elongation, relative to said output axis, of said resilient hand.

12. The display mechanism according to claim 10, wherein said first drive means and said second drive means are configured to hold said angular position in a fixed position, and to provide a linear display given solely by the elongation of said resilient hand.

13. The display mechanism according to claim 10, wherein said first drive means or said second drive means are held at a standstill.

14. The display mechanism according to claim 10, further comprising at least one other display hand moving in a counterbore of a dial or of a structure, and the outer diameter of said counterbore is smaller than the smallest elongation of said resilient hand which is arranged above a top surface of said dial or of said structure, situated above said other hand.

15. The display mechanism according to claim 1, further comprising means for controlling said first drive means and said second drive means, which are designed to cause an out-of-plane twisting or retraction of said resilient hand in the vicinity of an obstacle interfering with the trajectory thereof.

16. A timepiece comprising:

at least one of the display mechanism according to claim 1.

17. A timepiece display mechanism comprising:

at least one variable-geometry resilient hand which comprises a first drive pipe integral with a first end of a flexible strip, and a second drive pipe integral with another end of said flexible strip, and comprising a display index which, in an unstressed free state of said resilient hand wherein both said first pipe and said second pipe are not subjected to any stress and are remote from one another, is remote from said first pipe and from said second pipe the operating position of said resilient hand being a stressed position where said first pipe and said second pipe are coaxial to one another about an output axis;

first means for driving said first pipe about said output axis and second means for driving said second pipe about said output axis said first drive means and second drive means being arranged so as to deform said flexible strip, by varying the angular position of said second pipe relative to the angular position of said first pipe about said output axis, and so as to vary the radial position of said display index relative to said output axis, said resilient hand comprising at least one first flexible segment between said first pipe and said index with a first web having a substantially constant section, and a second flexible segment between said second pipe and said index with a second web having a substantially constant section, wherein:

said first flexible segment comprises first discontinuous elements projecting from said first web and extending substantially parallel to a plane perpendicular to said output axis and defining, along said first web, an alternation of sections, the stiffnesses thereof per unit of length are different from one another, or said second flexible segment comprises second discontinuous elements projecting from said second web and extending substantially parallel to a plane perpendicular to said output axis and defining, along said second web, an alternation of sections, the stiffnesses thereof per unit of length are different from one another, and wherein said resilient hand comprises at least one first flexible segment comprising a first decoration and a second flexible segment (comprising a second decoration which is designed to cover, by superimposition, over a part of the relative angular travel between said first pipe and said second pipe, all or part of said first decoration, or vice-versa.

18. The display mechanism according to claim 17, wherein said first decoration or said second decoration comprises a daytime/night-time indication or AM/PM indication designed to be seen by the user, and said second decoration or respectively said first decoration is designed to completely conceal said indication for a determined period of time.

19. A timepiece display mechanism comprising:

at least one variable-geometry resilient hand which comprises a first drive pipe integral with a first end of a flexible strip, and a second drive pipe integral with another end of said flexible strip, and comprising a display index which, in an unstressed free state of said resilient hand wherein both said first pipe and said second pipe are not subjected to any stress and are remote from one another, is remote from said first pipe and from said second pipe, the operating position of said resilient hand being a stressed position where said first pipe and said second pipe are coaxial to one another about an output axis;

first means for driving said first pipe about said output axis and second means for driving said second pipe about said output axis, said first drive means and second drive means being arranged so as to deform said flexible strip, by varying the angular position of said second pipe relative to the angular position of said first pipe about said output axis, and so as to vary the radial position of said display index relative to said output axis, said resilient hand comprising at least one first flexible segment between said first pipe and said index with a first web having a substantially constant section, and a second flexible segment between said second pipe and said index with a second web having a substantially constant section, wherein:

said first flexible segment comprises first discontinuous elements projecting from said first web and extending substantially parallel to a plane perpendicular to said output axis and defining, along said first web, an alternation of sections, the stiffnesses thereof per unit of length are different from one another, or said second flexible segment comprises second discontinuous elements projecting from said second web and extending substantially parallel to a plane perpendicular to said output axis and defining, along said second web, an alternation of sections, the stiffnesses thereof per unit of length are different from one another, and wherein said first web and/or said second web comprises a strand, the largest dimension of the section thereof is substantially parallel to said output axis, and said resilient hand comprises, in at least one plane perpendicular to said output axis a plurality of inertial elements, each attached to said strand by a rod, the section thereof is less than the section of said strand and less than the smallest section of said inertial element which is formed by said first element or by said second element.

* * * * *